United States Patent [19]

Scheibner

[11] Patent Number: 4,917,506

[45] Date of Patent: Apr. 17, 1990

[54] INTERLOCKING CLOSURE DEVICE HAVING CONTROLLED SEPARATION AND IMPROVED EASE OF OCCLUSION

[75] Inventor: Gerald H. Scheibner, Liberty Lake, Wash.

[73] Assignee: First Brands Corporation, Danbury, Conn.

[21] Appl. No.: 274,719

[22] Filed: Nov. 21, 1988

Related U.S. Application Data

[60] Continuation of Ser. No. 132,785, Dec. 14, 1987, abandoned, which is a division of Ser. No. 27,081, Mar. 17, 1987, Pat. No.

[51] Int. Cl.[4] ..... B65D 33/24

[52] U.S. Cl. ..... 383/63

[58] Field of Search ..... 383/63–65; 24/587

[56] References Cited

U.S. PATENT DOCUMENTS

| | | | |
|---|---|---|---|
| Re. 28,969 | 9/1976 | Naito | 383/63 |
| 3,153,269 | 10/1964 | Berry | 24/587 |
| 3,372,442 | 3/1968 | Isimatsu | 24/587 |
| 3,416,199 | 12/1968 | Imamura | 24/587 |
| 3,425,469 | 2/1969 | Ausnit | 383/63 |
| 4,186,786 | 2/1980 | Kirkpatrick | 383/63 |
| 4,212,337 | 7/1980 | Kamp | 383/63 |
| 4,747,702 | 5/1988 | Scheibner | 383/63 |

*Primary Examiner*—Stephen P. Garbe

*Attorney, Agent, or Firm*—Gary L. Wamer

[57] ABSTRACT

A female closure element comprising a U-shaped channel element including a profile portion comprising a base portion having a pair of spaced-apart, parallelly disposed webs extending from the base portion and terminating in hooks extending nonlinearly from the webs and facing each other. The hooks each include a projection extending nonlinearly in a direction facing away from each other. The female closure element may be employed with a male closure element having a U-shaped channel element including a profile portion comprising a base portion having a pair of spaced-apart, parallelly disposed webs attached to the base portion and extending therefrom, the webs terminating in hooks comprising hook portions facing away from each other and hook projections facing toward each other. The closure elements may be employed with containers to provide thereto improved ease of occlusion and controlled separation characteristics.

52 Claims, 9 Drawing Sheets

FIG. 8
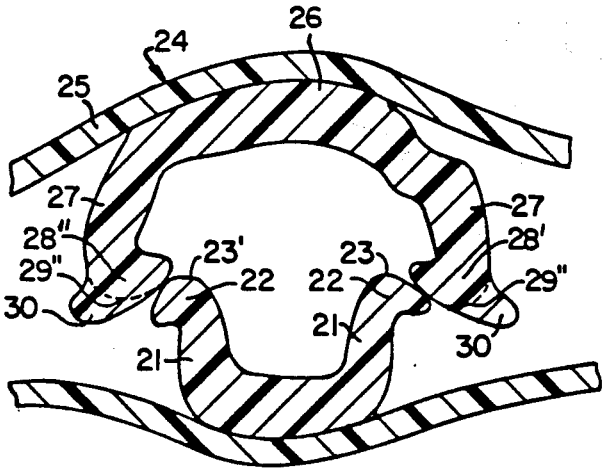
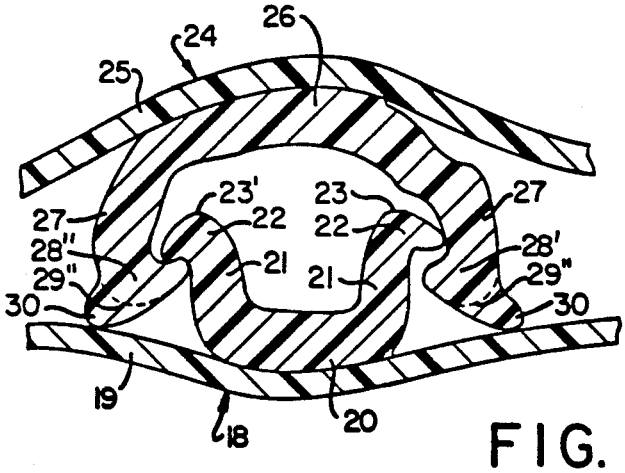
FIG. 9
FIG. 10
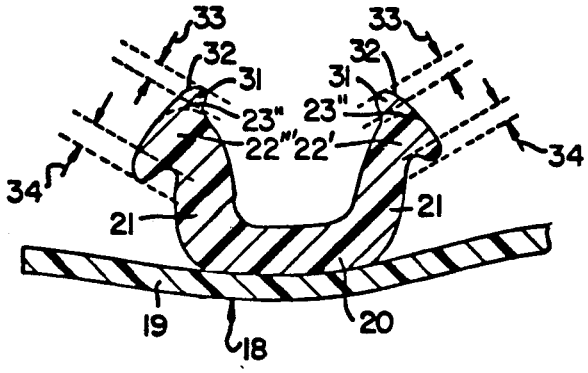

FIG. 11
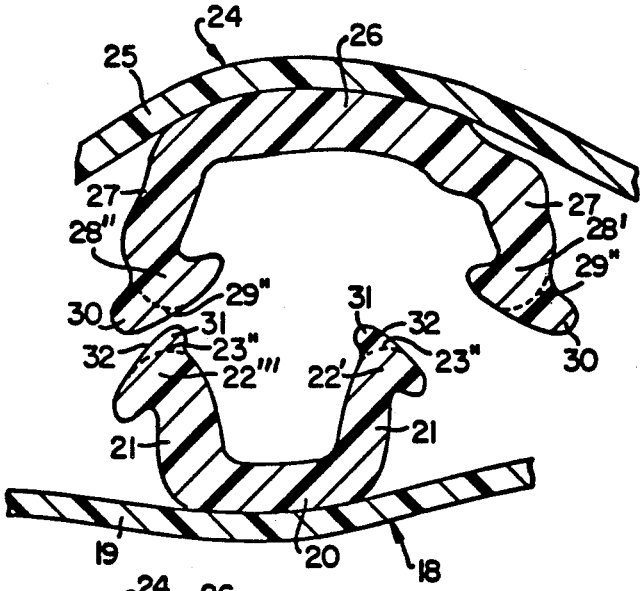
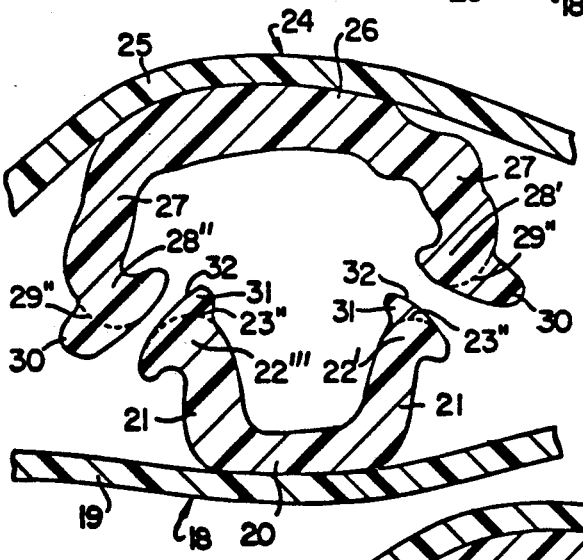
FIG. 12
FIG. 13
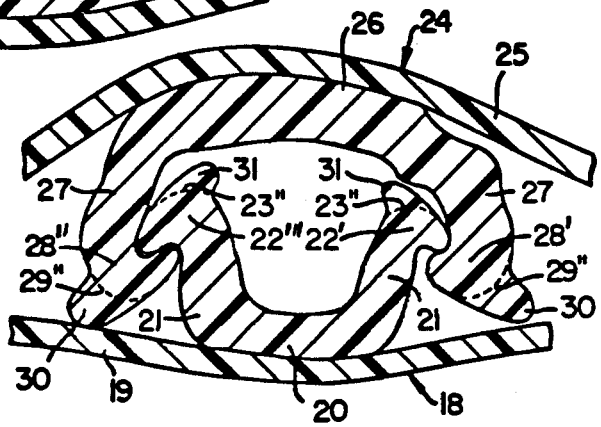

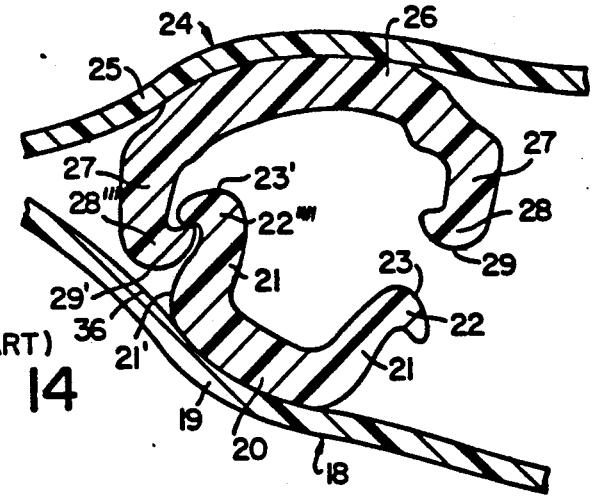
(PRIOR ART)
FIG. 14
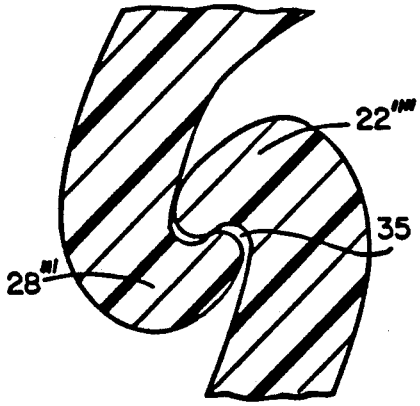
(PRIOR ART)
FIG. 15
FIG. 16
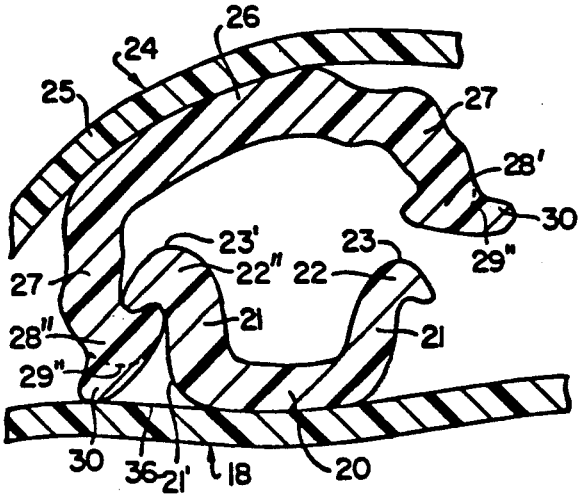

INTERLOCKING CLOSURE DEVICE HAVING CONTROLLED SEPARATION AND IMPROVED EASE OF OCCLUSION

CROSS REFERENCE TO RELATED APPLICATIONS

This application is a continuation of prior U.S. application Ser. No. 132,785 filed 12/14/87 which is a division of application Ser. No. 027,281 filed 3/17/87 which is a continuation of application Ser. No. 690,207 filed 1/10/85 which is a continuation-in-part of application Ser. No. 509,709 filed 3/30/83.

This application also is related to copending application Ser. No. 509,388 filed June 30, 1983, now abandoned for Interlocking Closure Device Having Improved Ease of Occlusion, and to copending application Ser. No. 509,708 filed June 30, 1983 for Controlled Separation Characteristics of Interlocking Closure Fastening Devices.

BACKGROUND OF THE INVENTION

1. Field of the Invention

This invention relates to closure fastening devices, and more particularly, to interlocking closure fastening devices having improved occlusion and deocclusion characteristics.

2. Discussion of the Prior Art

Generally, closure fastening devices for use with plastic bags and the like are well-known. In addition, manufacturing methods for closure devices made of plastic material are generally known.

Closure fastening devices for use with plastic bags should be relatively easy to open and close, and also provide a satisfactory seal. However, it has been found that some prior art interlocking closure fastening devices suffer from a tendency of the male and female closure elements to straddle each other and to not occlude during attempted occlusion as opposed to a normally occluded position. Such a non-occluded, and also straddled condition of the male and female closure elements on a plastic bag precludes occlusion of the closure elements and results in the bag contents not being securely contained within the bag. Therefore, a need exists to provide more positive guidance of the opposing closure elements such that the elements engage more repeatedly into the normally occluded condition, and that the elements be inhibited from engaging into a non-occluded and straddled condition.

In addition, prior art interlocking closure fastening devices suffer from lack of significant controlled separation, i.e., deocclusion characteristics. The controlled separation characteristic of a closure device may be described as the ability to resist opening any further than the initial gap induced by the original opening force of the user. This deficiency in controlled separation manifests itself during opening of a plastic container or bag and is especially troublesome to a user during the closing or sealing operation of the container. More specifically, when plastic bags having closure fastening devices are partially opened, they can continue to open completely with little or no external separating force applied to the fastening devices. Such a characteristic is desirable for opening the plastic bag but presents a disadvantage on closure since the user often desires to expel the preponderance of air from the bag prior to sealing. This is most desirably accomplished if the major portion of the fastening device is interlocked, and only a small aperture remains for expelling most of the residual air from the bag before accomplishing the final closure and sealing. Thus, there is a need to provide closure fastening devices which have controlled separation characteristics so that a partially occluded bag will not deocclude, except to the extent that the user may further apply an opening force.

It would also be desirable to provide interlocking closure fastening devices having controlled separation characteristics while not adversely affecting the force required to deocclude the outside hooks of the interlocked closure fastening device, i.e., the initial opening force, so that it is still relatively easy to open from the outside. Likewise, it would further be desirable to provide interlocking closure fastening devices having controlled separation characteristics while maintaining the force required to deocclude the inside hoods of the interlocked closure fastening device so that it will be relatively harder to open from the inside than from the outside in order to provide secure containment of goods in a container or bag equipped with the interlocking closure fastening device.

SUMMARY OF THE INVENTION

In accordance with this invention, generally speaking, there is provided an interlocking closure fastening device having an occluded height of between about 50 mils and about 100 mils, preferably about 70 mils, and a corresponding occluded width of between about 60 mils and about 150 mils, preferably about 110 mils, comprising a female closure element and a male closure element, formed such that the male closure element and the female closure element engage in interlocking relationship wherein the female closure element includes a profile portion comprising a base portion with a pair of spaced-apart, parallelly disposed webs integrally attached to the base portion and spaced to pass over the webs on the male closure element, wherein the webs on the female closure element terminate in hooks facing toward each other to engage the hooks on the male closure element. The male closure element includes a profile portion comprising a base portion having a pair of spaced-apart, parallelly disposed webs attached to the base portion and extending therefrom, said webs terminating in hooks facing away from each other.

More specifically, in accordance with this invention, the female closure element comprises a U-shaped channel element including a profile portion comprising a base portion having a pair of spaced-apart, parallelly disposed webs extending from the base portion, the webs terminating in hooks which extend nonlinearly from the webs, and wherein the hooks face towards each other. The hooks also each include a projection extending nonlinearly therefrom in the form of a wing or ear wherein the projections extend in a direction facing away from each other. The pair of projections extending from the hooks increase the width of the transverse opening between the webs in the area of the hooks and provide a funneling action to guide occlusion of the female closure element with a complementary male closure element. The projections included on the female closure element inhibit the tendency for just one of the webs of the male closure element to enter the opening between the webs of the female closure element, i.e., straddling. The female closure element of this invention thus reduces the potential for straddling when occluding an interlocking closure fastening device comprising a female closure element and a male closure element, thereby resulting in greater ease of occlusion and the obtainment of secure occlusion therebetween. The projections on the female closure element reduce the necessity for precise alignment with the profile portions of a male closure element to attain proper occlusion therewith. Thus, the closing operation of an interlocking closure fastening device is facilitated for the user since occlusion is less dependent on precise transverse alignment of the interlocking profile elements.

In addition, the projections on the female closure element cause the interlocked profile elements to resist continued separation after partial deocclusion, thereby providing controlled separation of the interlocked profile elements. The controlled separation of the profile elements is due in part to contact interference between the female closure element projections and the male flange portions immediately adjacent the male profile portion during the process of deocclusion, and in part due to the length of engagement between the hooks of the male and female closure halves facing the inside of the bag. The projections extending from the hooks of the female closure element each have a length, on a proportionate scale to the occluded height and occluded width of the interlocking closure fastening device, of between about 8 mils and about 18 mils, and the hooks of the female closure element have a length, on a proportionate scale to the occluded height and occluded width of the interlocking closure fastening device, of between about 5 mils and about 12 mils, and preferably about 12 mils.

In a preferred embodiment of this invention, the female closure element of this invention is preferably employed with a male closure element as described in U.S. Ser. No. 509,388 filed June 30, 1983. Said male closure element comprises a U-shaped channel element including a profile portion comprising a base portion having a pair of spaced-apart, parallelly disposed webs attached to the base portion and extending therefrom, said webs terminating in hooks facing away from each other. The hooks on each web of the male closure element comprise a hook portion and a hook projection wherein the two hook portions face away from each other, and the two hook projections face toward each other. The two hook projections facing toward each other reduce the width of the transverse opening between the webs of the male closure element in the area of the hooks, thereby inhibiting the tendency for either of the webs of the female closure element to enter the opening between the webs of the male closure element, i.e, straddling. This male closure element reduces the potential for straddling when occluding an interlocking closure fastening device comprising a male closure element and a female closure element, thereby resulting in greater ease of occlusion and the obtainment of proper secure occlusion. The hook projections of the male closure element have lengths, on a proportionate scale to the occluded height and occluded width of the interlocking closure fastening device, of between about 5 mils and about 20 mils, and the hook portions of the male closure element have lengths, on a proportionate scale to the occluded height and occluded width of the interlocking closure fastening device, of between about 5 mils and about 12 mils and preferably about 10 mils.

As employed herein, the term "proportionate" indicates the relative proportions of the closure elements of the interlocking closure fastening device when the male and female closure elements are occluded. Thus, when the interlocking closure fastening device of this invention has an occluded height of between about 50 mils and about 100 mils, and an occluded width of between about 60 mils and about 150 mils, the lengths of the hook portions of the female closure element are between about 5 mils and about 12 mils, and the lengths of the hook projections of the female closure element are between about 8 mils and about 18 mils on a proportionate scale to the occluded height and occluded width of the interlocking closure fastening device. Likewise, the lengths of the hook portions of the male closure element should be between about 5 mils and about 12 mils, and the lengths of the hook projections of the male closure element should be between about 5 mils and about 20 mils on a proportionate scale to the occluded height and occluded width of the interlocking closure fastening device. Accordingly, when the occluded height and occluded width of the interlocking closure fastening device of this invention are either increased or decreased, then the lengths of the hook portions and hook projections of the female closure element and those of the male closure element should be proportionately increased or decreased to maintain the relative proportions of the closure elements.

In a further embodiment of this invention, the aforedescribed male and female closure elements have at least one base portion which is resiliently bendable.

Other embodiments of this invention comprise a container including the aforedescribed female closure element, or a container including said female closure element and said aforedescribed male closure element.

This invention accordingly comprises the features of construction, combination of elements, and arrangements of parts which will be exemplified in a construction hereinafter set forth.

BRIEF DESCRIPTION OF THE DRAWINGS

FIG. 8 is a sectional view of a female closure element in accordance with this invention and a prior art male closure element in a properly aligned position just prior to occlusion;

FIG. 9 is a sectional view of a female closure element in accordance with this invention and a prior art male closure element in an occluded position;

FIG. 10 is a sectional view of a male closure element in accordance with that shown in U.S. application Ser. No. 509,388 filed June 30, 1983;

FIG. 11 is a sectional view of the female closure element shown in FIG. 6 and the male closure element shown in FIG. 10 in a misaligned position;

FIG. 12 is a sectional view of the female closure element shown in FIG. 6 and the male closure element shown in FIG. 10 in a properly aligned position;

FIG. 13 is a sectional view of the female closure element shown in FIG. 6 and the male closure element shown in FIG. 10 in a occluded position;

FIG. 14 is a sectional view of a prior art closure fastening device in a partially deoccluded position;

FIG. 15 is a sectional view of part of a prior art closure fastening device wherein one pair of hooks is in an engaged condition, as in the occluded position;

FIG. 16 is a sectional view of a female closure element in accordance with this invention and a male closure element in accordance with that shown in U.S. Ser. No. 509,708 filed June 30, 1983 in a partially deoccluded position;

DETAILED DESCRIPTION OF THE INVENTION

In describing the invention, certain embodiments have been illustrated in the accompanying drawings and described in this specification.

Figure 1:
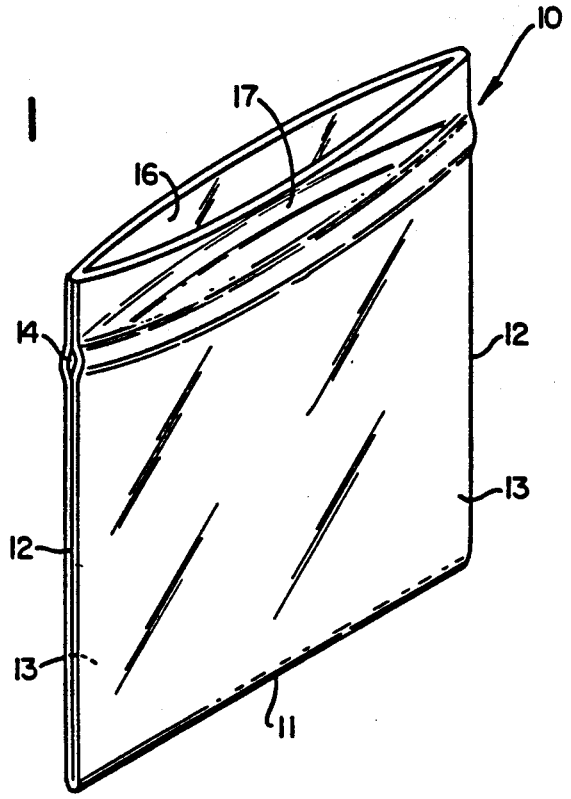
FIG. 1 is a perspective view of a flexible container including a closure fastening device in accordance with the invention.

FIG. 1 shows a typical flexible container 10 formed from a plastic film which is folded at bottom portion 11 and is heat sealed along the side edges 12 to form a pouch or bag. The sidewalls 13 may extend beyond a closure fastening device 14 to provide grasping sections 16 and 17 to simplify the opening of closure fastening device 14.

A prior art closure device is shown in the straddled, misaligned, properly aligned, and occluded positions in FIGS. 2, 3, 4 and 5, respectively.

Figure 2:
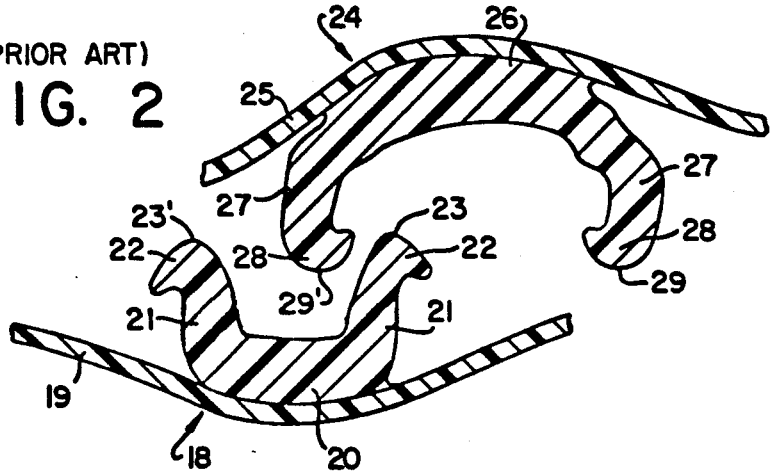
(PRIOR ART) FIG. 2
FIG. 2 is a sectional view of a non-occluded closure fastening device in accordance with the prior art in a straddled position.

As shown in FIG. 2, a male profile portion 18 is connected to a flange portion 19 and includes a base portion 20, a pair of spaced-apart, parallelly disposed first webs 21 extending in a generally normal direction from the base portion 20, and male hook portions 22 extending from webs 21 and facing away from each other. The male hook portions each have a rounded crown surface 23, and 23', which generally serve to guide the hook portions for occlusion with the female hook portions of a mating closure element. A female profile portion 24 is connected to flange portion 25 and includes a base portion 26, a pair of spaced-apart, parallelly disposed webs 27 extending in a generally normal direction from the base portion 26, and female hook portions 28 extending from webs 27 and facing towards each other. The female hook portions each have a rounded crown surface 29, and 29', which serve to guide the hook portions for occlusion with male hook portions of a mating closure element. Profile portions 18 and 24, as shown in FIG. 2, may be separately formed and thereafter connected to a film which forms sidewalls 13, or they may be integrally formed with sidewalls 13 as shown in FIG. 1.

As can be seen from FIG. 2, when a non-occluded closure fastening device in accordance with the prior art is in a straddle position, just prior to attempted occlusion, the web and hook portions of one of the closure elements will drop into the void or open channel between the web and hook portions of the other closure element and occlusion of the mating closure elements does not occur. This straddle position of the channel closure elements on a plastic bag results in the bag contents not being securely contained within the bag.

Figure 3:
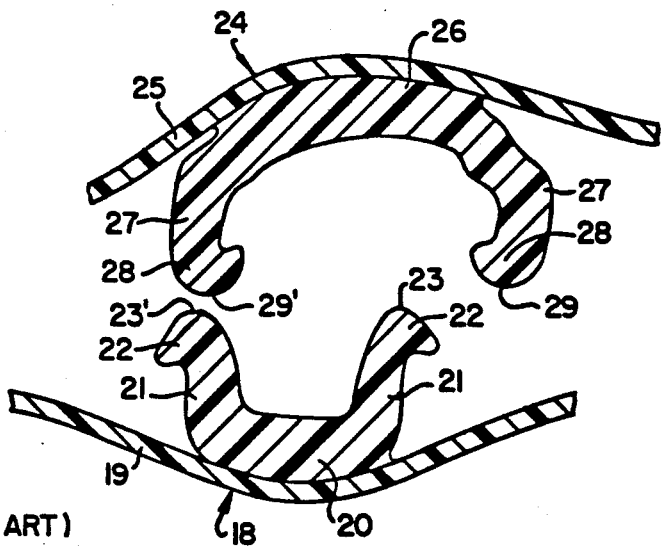
(PRIOR ART) FIG. 3
FIG. 3 is a sectional view of the closure fastening device of FIG. 2 in a misaligned position.
Figure 5:
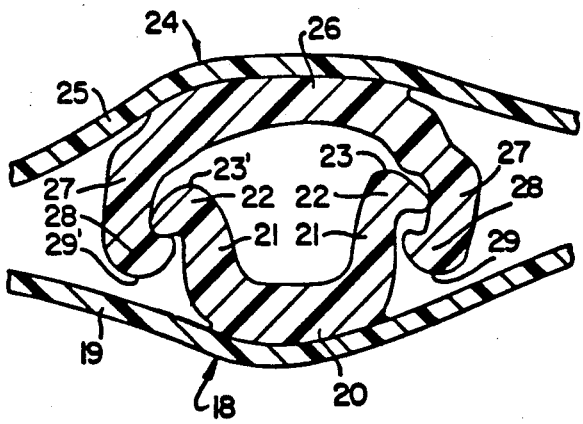
(PRIOR ART) FIG. 5
FIG. 5 is a sectional view of the closure fastening device of FIG. 2 in an occluded position.

FIG. 3 depicts the non-occluded closure fastening device of FIG. 2 in a misaligned position just prior to attempted occlusion. When male profile portion 18 is misaligned with female profile portion 24 just prior to attempted occlusion of the interlocking closure fastening device, surface 23' of one of the two male hook portions 22 and the surface 29' of one of the two female hook portions 28 are in a balance such that surface 23' and surface 29' can slide either into an occluded position, as shown in FIG. 5, or into a straddling position, as shown in FIG. 2.

Figure 4:
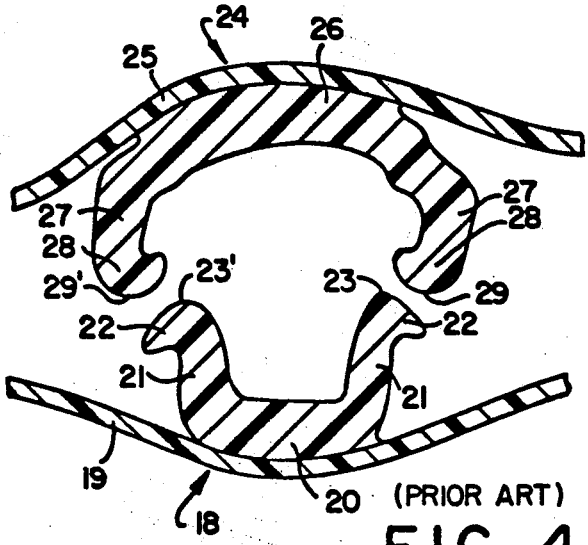
(PRIOR ART) FIG. 4
FIG. 4 is a sectional view of the closure fastening device of FIG. 2 in a properly aligned position just prior to occlusion.

To assure occlusion of prior art interlocking closure fastening devices, the male profile portion 18 and female profile portion 24 must always be in proper transverse alignment just prior to attempted occlusion of the closure devices as shown in FIG. 4. That is, surfaces 23 and 23' of both male hook portions 22 should be in a laterally inward position with respect to surfaces 29 and 29' of both female hook portions 28. When contacting pressure is applied to interlocking closure fastening devices aligned in the position shown in FIG. 4, the male profile portion 18 and the female profile portion 24 are interlocked in the normally occluded position shown in FIG. 5.

Figure 6:
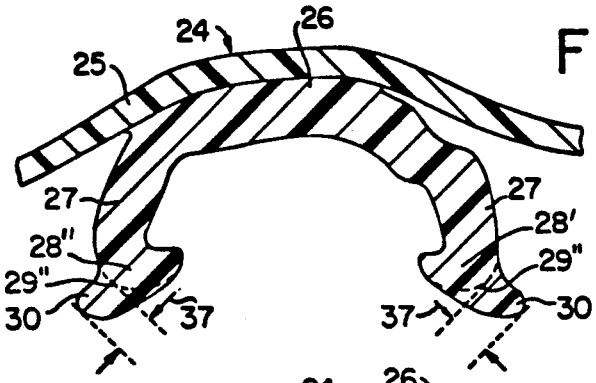
FIG. 6 is a sectional view of a female closure element in accordance with this invention.

In FIG. 6, the female closure element in accordance with this invention is shown in detail, wherein a pair of extensions or projections 30 on hooks 28' and 28" can be seen extending from the broken lines 29" shown therein to form an enlarged span between the hooks 28' and 28". The projections 30 extend nonlinearly from the hooks 28' and 28" and in a direction away from each other, thereby increasing the width of the transverse dimension in the space between the hooks to provide a guiding action for engagement with a male closure element. One effect of the projections 30 is to physically guide the hook portions of the male closure element into alignment with the hook portions of the female closure element and thereby inhibit the interlocking closure elements from slipping into the undesired straddling position earlier discussed and shown in FIG. 2. Such guidance of the hook portions of the male closure element by the projections on the female closure element assists the engagement of the closure elements into their proper occluded position.

In accordance with this invention, projections 30 may be any suitable length and configuration to provide the desired degree of guiding effect to the hook portions of the male closure element. However, satisfactory results have been obtained when projections 30 have lengths, on a proportionate scale to the occluded height and occluded width of the interlocking closure fastening device, of between about 8 mils and about 18 mils as measured between the dotted lines 37 shown in FIG. 6.

Further, when projections 30 of the female hook portions 28' and 28'' are contoured as shown in FIG. 6, it has been found that such a construction is more forgiving to misalignment and provides more positive guidance of the mating closure elements, and the elements engage more easily and accurately into the desired occluded position compared to prior art interlocking closure fastening devices.

Figure 7:
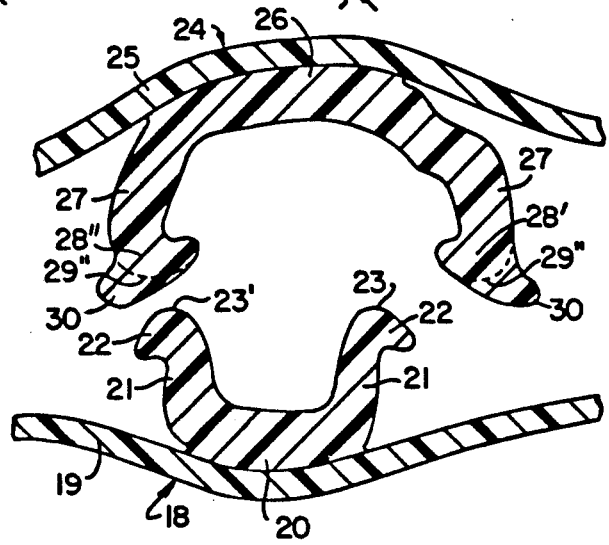
FIG. 7 is a sectional view of a female closure element in accordance with this invention and a prior art male closure element in a misaligned position.

FIG. 7 shows a female closure element in accordance with this invention in a misaligned position with respect to a prior art male closure element just prior to occlusion therewith. It can be seen that even though the female closure element and the male closure element are misaligned as much as shown in FIG. 3, they will be guided into the desired occluding alignment by hook projections 30 nonlinearly extending away from each other and from female hook portions 28' and 28'' for ultimate interlocking occlusion.

In FIG. 8 it can be seen that when the female closure element in accordance with this invention is properly aligned with a prior art male closure element just prior to occlusion, such will not only lead to greater ease of occlusion therebetween, but will also inhibit the movement of the female closure element and the male closure element into a straddle position.

In FIG. 9, the female closure element of this invention is shown in the normally occluded position with a prior art male closure element.

In FIG. 10, a male closure element is shown in accordance with that disclosed in U.S. Ser. No. 509,388, filed June 30, 1983, wherein hook projections 31 on hook portions 22' and 22''' can be seen extending from the broken lines 23'', shown therein, to form a reduced gap between hook portions 22' and 22''', to thereby physically hinder the straddling of a male closure element and a female closure element as previously shown in FIG. 2. Thus, the desired avoidance of the straddle position that could occur between a male closure element and a female closure element is obtained, and likewise, the other desired characteristic of ease of occlusion is enabled by providing a guiding action for the hook surfaces of the female closure element to slide along the outside surfaces 32 of hook portions 22' and 22''' of the male closure element. Such guidance helps direct the male and female closure elements into their proper occluded position. As disclosed in said U.S. Ser. No. 509,388, hook projections 31 may be any suitable length so as to virtually close the gap or void between them and preclude entrance therein of the hook and web portions of the female closure element, thereby virtually insuring occlusion and eliminating straddling between the male and female closure elements.

Manufacturing considerations may limit the extent to which hook projections 31 are brought close together thereby reducing the guidance effect between the male closure element of said invention and the interlocking female closure element of the instant invention. Satisfactory results have been obtained when the hook projections 31 on said male closure element have lengths, on a proportionate scale to the occluded height and occluded width of the interlocking closure fastening device, of between about 5 mils and about 8 mils as measured between the dotted lines 33 shown in FIG. 10. However, it is preferred that said hook projections 31 have lengths, on a proportionate scale to the occluded height and occluded width of the interlocking closure fastening device, of between about 5 mils and about 20 mils, as such lengths provide the aforementioned desired characteristics to interlocking closure fastening devices. Further, the hook portions 22' and 22''' of the male closure element have lengths, on a proportionate scale to the occluded height and occluded width of the interlocking closure fastening device, of between about 5 mils and about 12 mils as measured between the dotted lines 34 shown in FIG. 10.

FIG. 11 shows a female closure element in accordance with this invention in a misaligned position with respect to the male closure element disclosed in U.S. Ser. No. 509,388 just prior to occlusion therewith. It can be seen that even though the female closure element and the male closure element are misaligned, as much as shown in FIG. 3, they will be guided into the desired occluding alignment by female hook projections 30 extending away from each other from female hook portions 28' and 28'', and by male hook projections 31 extending toward each other from male hook portions 22' and 22''', for ultimate interlocking occlusion.

In FIG. 12, it can be seen that when the female closure element in accordance with this invention is properly aligned with respect to the male closure element disclosed in U.S. Ser. No. 509,388 just prior to occlusion, such will not only lead to greater ease of occlusion therebetween, but will inhibit the transverse movement of the female closure element and the male closure element into a non-occluded straddle position.

FIG. 13 shows the novel female closure element of this invention in the occluded position with a male closure element as disclosed in U.S. Ser. No. 509,388. In FIG. 13, the female closure element includes projections 30 each having a length, on a proportionate scale to the occluded height and occluded width of the interlocking closure fastening device, of about 14 mils and the inside hook portion 28'' has a length, on a proportionate scale to the occluded height and occluded width of the interlocking closure fastening device, of about 10 mils. The male closure element has inside hook portion 22''' have a length, on a proportionate scale to the occluded height and occluded width of the interlocking closure fastening device, of about 10 mils, and hook projections 31 each having a length, on a proportionate scale to the occluded height and occluded width of the interlocking closure fastening device, of about 7 mils.

FIG. 14 shows a prior art interlocking closure fastening device in a partially deoccluded position. In FIG. 14, the inside male hook 22'''', and the inside female hook 28''', have lengths, on a proportionate scale to the occluded height and occluded width of the interlocking closure fastening device, of 5 mils, and 6 mils, respectively. The inside male hook 22'''' and the inside female hook 28''' form the pair of hooks which are positioned closer to the inside of the container than the other pair of complementary hooks and are shown herein as the engaged pair of hooks.

FIG. 15 shows a prior art interlocking closure fastening device wherein one pair of hooks is in an engaged position. As can be seen from FIG. 14 and FIG. 15, during deocclusion of the male closure element and the female closure element, there is almost no entrapment of the inside female hook 28''' in the space defined by the inside male hook cavity 35, nor with the flange portion 36 adjacent the inside web portion 21' of the male closure element.

FIG. 16 shows the female closure element of this invention and a male closure element in accordance with that disclosed in U.S. Ser. No. 509,708 in a partially deoccluded position. In FIG. 16, the inside male hook 22", and the inside female hook 28", have lengths, on a proportionate scale to the occluded height and occluded width of the interlocking closure fastening device, of 9 mils, and 10 mils, respectively. Projections 30 on the female closure element have a length, on a proportionate scale to the occluded height and occluded width of the interlocking closure fastening device, of 12 mils.

Figure 17:
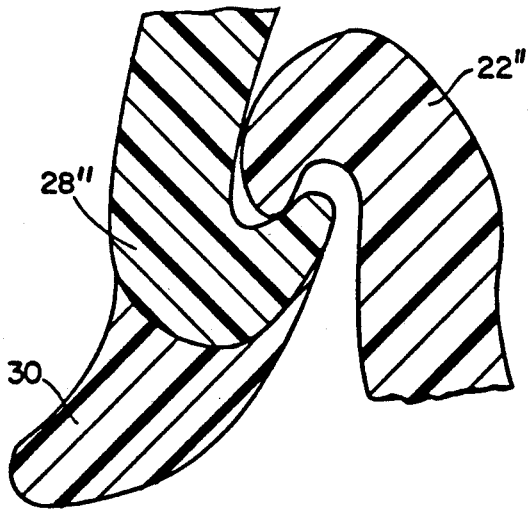
FIG. 17 is a sectional view of part of a female closure element in accordance with this invention and part of the male closure element shown in FIG. 16 wherein one pair of hooks is in an engaged condition, as in the occluded position.
Figure 18:
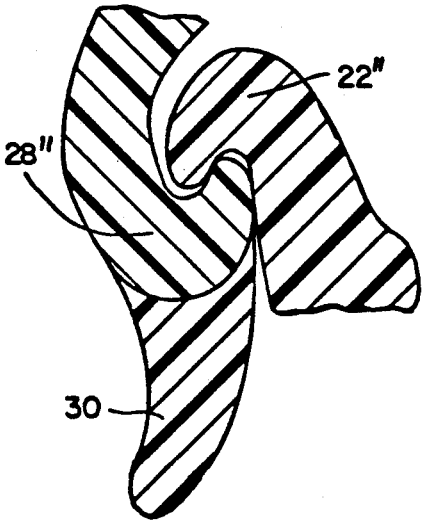
FIG. 18 is a sectional view of part of a female closure element in accordance with this invention and part of the male closure element shown in FIG. 16 in a partially rotated position, such as during deocclusion.

It can be seen from FIG. 17 and FIG. 18, during deocclusion of the female closure element of this invention and a male closure element as in U.S. Ser. No. 509,708, that significant entrapment occurs between the inside female hook 28" and the inside male hook 22". That is, it can be seen that the hooks are spatially hindered from further rotation, thereby resisting further deocclusion. Entrapment also occurs as shown in FIG. 16 between projection 30 on the inside female hook 28" and the flange portion 36 adjacent the inside male web portion 21' of the male closure element. These portions of the closure fastening device require substantial bending and/or distortion thereof for complete deocclusion therebetween. Such required bending and/or distortion of the aforementioned closure elements results in controlled separation during deocclusion of the interlocked closure fastening device.

Figure 19:
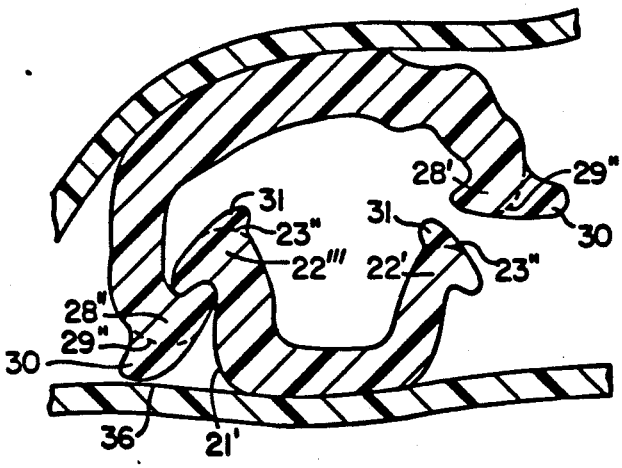
FIG. 19 is a sectional view of a female closure element in accordance with this invention and the male closure element shown in FIG. 10, in a partially deoccluded position.

FIG. 19 shows the female closure element of this invention and the male closure element pursuant to U.S. Ser. No. 509,388 in a partially deoccluded position. In FIG. 19, the inside male hook 22"' and the inside female hook 28", have lengths, on a proportionate scale to the occluded height and occluded width of the interlocking closure fastening device, of 10 mils, and 10 mils, respectively. Projections 30 on the female closure element each have a length, on a proportionate scale to the occluded height and occluded width of the interlocking closure fastening device, of 14 mils. Hook projections 31 on the male closure element each have a length, on a proportionate scale to the occluded height and occluded width of the interlocking closure fastening device, of 7 mils It can also be seen in FIG. 19 that during deocclusion of this closure fastening device, substantial entrapment occurs between the inside female hook 28" and the inside male hook 22"'. Entrapment also occurs between projection 30 on the inside female hook 28" and the male flange portion 36 adjacent the inside web portion 21' of the male closure element. These portions of the closure fastening device require significant bending and/or distortion for complete deocclusion of the closure fastening device. Such required bending and/or distortion of the closure elements provides controlled separation during deocclusion of the interlocked closure fastening device.

When so contoured, the controlled separation characteristics of interlocking closure fastening devices, as provided by the female closure element of this invention, are the result of the following mechanism during the deocclusion. Separation of interlocking closure fastening devices involves disengagement of entrapped fitted sections of the closure profiles. Controlled separation results when one or more fitted sections of an occluded closure profile cannot easily separate from its or their corresponding matched sections via minor bending or distortion of either of their sections. This minor bending or distortion is restricted by the presence of projections 30 on the female closure element.

If desired, different materials can be used to form either or both of the matched sections of the closure devices so as to yield greater stiffness in the sections to be bent or distorted during deocclusion. Further, the size of matched sections can be increased or decreased to also correspondingly influence stiffness. In addition, the length of any engaging hooks of the closure devices can be increased or decreased to correspondingly cause greater or lesser entrapment of the fitted hook sections of the closure devices.

It should be noted that during the occlusion operation of a female profile portion and a male profile portion, at least one of the base portions flexes, or the webs flex, or the hooks flex, or a combination of these parts flex to achieve occlusion.

In accordance with this invention, separation of the resulting closure fastening device sections from an occluded condition becomes more controlled. This controlled separation is due to greater spatial hindrance of the inside female hook and hook projection during the process of deocclusion with the inside hook portion of the male closure element. Hindrance results from the inside male closure hook rotating, with respect to the inside female closure hook, and engaging therewith more completely as the outside hooks begin to separate, or are separating. Further separation is prevented by the entrapment of the inside female hook and projection in the cavity defined by the inside male hook and flange adjacent the inside male web. Separation then becomes possible only through bending and/or distortion of the hooks and/or adjacent areas, a process which requires greater force than that of the simple flexing of bases, webs and hooks during deocclusion of a conventional closure fastening device.

Generally, the closure fastening devices of this invention may be formed from thermoplastic materials such as polyethylene, polypropylene, nylon, or the like, or from a combination thereof. Thus, resins or mixtures of resins such as high density polyethylene, medium density polyethylene and low density polyethylene may be employed to prepare the novel closure device of this invention.

The closure fastening device of the invention may be manufactured by extrusion, or other known methods of producing such devices. The closure fastening device can be manufactured as individual closure elements for later attachment to a film, or the closure elements can be manufactured integral with a film. In addition, the closure fastening device can be manufactured with or without flange portions on one or both of the closure elements depending upon intended use or expected additional manufacturing operations.

In the practice of the instant invention, the closure fastening device may be integrally formed with the sidewalls of a container, or connected to a container, or to a film to be formed into a container, by the use of any of many known methods. A thermoelectric device can be applied to a film in contact with the flange portion of a closure element, or the thermoelectric device can be applied to a film in contact with the base portion of a closure element having no flange portion, to cause a transfer of heat through the film to produce melting at the interface of the film and the flange portion or base portion of the closure element. On cooling, the interface region joins the film and the closure element. The thermoelectric device can be heated rotary discs, or resistance heated slide wires, or traveling heater bands, or the like. The connection between the film and the closure element can also be established by the use of hot melt adhesives, or hot jets of air to the interface, or ultrasonic heating, or other known methods. Generally, the closure fastening device and films can be made from a heat sealable materials so that a container can be formed economically by heat sealing the aforementioned components to form the container.

The closure fastening device of this invention provides many advantages for use in containers to be used by consumers. For example, the closure device is easy to occlude and does not tend to twist and distort during attempted occlusion as in the case of some prior art devices such as the arrowhead-shaped device employed with a container available under the tradename ZIPLOC®. This provides convenience in the occluding operation.

In addition, the closure fastening device is more difficult to deocclude from the inside of the containers than from the outside of the containers, thereby providing more secure containment of goods such as food products. The profile portions of the closure device have approximately uniform cross-sections. This not only simplifies the manufacturing of the device but it also contributes to the physical flexibility of the device, which is a desirable property.

In the examples, the following procedure was employed to evaluate the degree of controlled separation provided by various occluded closure fastening devices. An occluded closure fastening device sample was cut into three 12 inch long samples. The closure fastening device samples were each partially deoccluded or peeled apart at one end only. Each sample was tested independently as described herein. The partially deoccluded male portion of the closure fastening device was mounted in the upper jaw, and the female portion of the closure fastening device was mounted in the lower jaw of an Instron® tensile tester. The peel tension from the occluded closure fastening device is recorded on a strip chart recorder during deocclusion of a 8 to 10 inches of the closure fastening device sample. The average value is taken visually from the near linear portion of the recording and is recorded as average zipper strength. The jaw separation (deocclusion) rate is 20 inches per minute and the full scale load is 100 grams. Each sample was reoccluded and retested for a total of 3 tests. The average value is reported for the three tests for all three samples.

The Instron instrument is a tensile tester Model No. 1130, using a load cell with a zero to 100 gram range. The Instron tester is initially calibrated in the following manner. The pen and charge recorder are turned on. The zero button is pressed and held, and the zero adjust knob is positioned for a 0.00 reading on the recorder. The zero button is then released. The range switch is then turned to the setting of 1 on its 1, 2, 5, 10, 20 scale. The coarse balance control is turned so that if the pen is all the way over to the left, it starts coming towards zero on the right. The coarse balance control is left at this position. Then the fine balance control is turned so that the pen is at a setting of 0.00. A 100 gram weight is place in the upper jaw of the Instron instrument and the calibration control is adjusted for a full-scale recorder reading. After removing the 100 gram weight, the recorder should again read 0.00. The zero button is pressed and held, and the recorder should again read 0.00.

The test results are given in Table 1.

TABLE I

| Closure Fastening Device | Average Zipper Strength (In Grams) |
|---|---|
| Control | 8 |
| Example 1 | 25 |
| Example 2 | 50 |
| Example 3 | 70-86 |

The Control represents a channel closure fastening device whose general configuration is depicted in FIG. 5. It is employed commercially as the closure fastening device for a container sold under the tradename SNAP LOCK® by Union Carbide Corporation, Danbury, CT. The Control closure fastening device was made with low density polyethylene, that is, having a density of about 0.923 grams per cubic centimeter, wherein the lengths of the inside hooks of the male and female closure elements were about 6 mils.

Example 1 was the same as the Control except that the female closure element was made with projections 30 as depicted in FIG. 6, each having a length of about 12 mils.

The closure fastening device of Example 2 was the same as the Control, except that the inside male and female hooks were lengthened from 6 mils to 10 mils.

The closure fastening device of Example 3 was the same as that of Example 1, except that the polyethylene material employed to prepare the female closure element contained about 20 percent by weight of high density polyethylene, having a density of about 0.960 g/cm$^3$, based on the weight of the closure element.

From the above results in Table 1, the average zipper strength values represent the amount of resistance encountered to further opening of the partially deoccluded closure fastening devices. This value is measured in grams when peeling or zippering the male and female portions apart in the lengthwise direction. It can be seen from the above values that the presence of projections 30 on the female closure element structure of this invention substantially increases the zipper strength of an interlocking closure fastening device.

Further improvement in controlled separation characteristics of interlocking closure fastening devices are obtained by lengthening the inside male and female hooks, i.e., the pair of hooks which is closer to the inside of the container. Further zipper strength improvement is provided to closure fastening devices by employing resin having greater stiffness. These improvements may be further observed from the data given below in Table II.

For the data in Table II, the following procedures were employed to determine the force required to deocclude the outside hooks of interlocked closure fastening devices, and the force required to deocclude the inside hooks of interlocked closure fastening devices. (1) Three plastic bags having an interlocking closure fastening device near their opening are obtained for each evaluation. The outside flanges of the fastening devices are marked for identification of the outside hooks. (2) The fastening devices are separated from the bags by cutting across the width of the bag at about 1/16 inch below the inner female flange of the closure device. (3) Four strips of about 1 inch wide adhesive tape such as Scotch Tape® are cut into about 2½ inch lengths. Two of the adhesive tape strips are attached to each of the outside flanges of the closure so that the adhesive tape strips face each other. The adhesive strips are attached to the flanges at an angle of about 90° relative to the length of the closure sample. The ends of the adhesive tape strips adhering to the closure flanges should be within about 1/16 inch of the closure channel. (4) The free ends of the adhesive tape strips are clamped in the jaws of an Instron Tester Model A 350-108A for determination of the load required to separate and deocclude the interlocked closure elements. The jaw separation rate is set at 20 inches per minute, and a full scale load of 10 pounds. (5) After deocclusion, the closure elements are reoccluded and the sample retested. This procedure is repeated until the load required to separate the closure elements from the outside has been determined five times. The individual test and average values are recorded. (6) Using the same specimen as in steps 3, 4, and 5, adhesive tape strips are attached to the inside flanges of the closure for determination of the load required to separate and deocclude the closure from the inside of the plastic bags. This determination is only made once. (7) The aforedescribed procedures are followed to determine the outside and inside force required to deocclude the closure specimens obtained from bags two and three. (8) The average load or force values needed to deocclude the interlocked closure fastening device from the outside and from the inside are summarized as shown in Table II.

TABLE II

| Closure Fastening Device | Outside Hooks Deocclusion Force (in pounds) | Inside Hooks Deocclusion Force (in pounds) | Average Zipper Strength (in grams) |
|---|---|---|---|
| Control | 2.77 | 5.41 | 8–10 |
| Example 4 | 2.43 | 5.75 | 24–25 |
| Example 5 | 2.75 | 4.5 | 50 |
| Example 6 | 3.41 | 5.76 | 70 |
| Example 7 | 2.33 | 4.8 | 86 |

The Control represents a channel closure fastening device whose general configuration is depicted in FIG. 5. It is employed commercially as the closure fastening device for a container sold under the tradename SNAP LOCK® by Union Carbide Corporation, Danbury, CT. The Control closure fastening device was made with low density polyethylene, that is, having a density of about 0.923 grams per cubic centimeter, wherein the lengths of the inside hooks of the male and female closure elements were about 6 mils.

Example 4 was the same as the Control except that the female closure element was made with projections 30 as depicted in FIG. 6, each having a length of about 11.5 mils, the inside hooks having a length of about 8.6 mils, and the outside hook having a length of about 6.6 mils.

The closure fastening device of Example 5 was the same as the Control except that the female closure element was made with projections 30, and the male closure element was made with projections 31 as depicted in FIG. 19. Projections 30 each had a length of about 12.6 mils, projection 31 on the inside hook had a length of about 4.6 mils, whereas projections 31 on the outside hook had a length of about 5.3 mils. In addition, the inside hook of the male closure element had a length of about 11.3 mils.

The closure fastening device of Example 6 was the same as that of Example 5 except that the polyethylene material employed to prepare the female closure element contained about 20 percent by weight of high density polyethylene, having a density of about 0.960 g/cm$^3$, based on the weight of the closure element.

The closure fastening device of Example 7 was the same as the Control except that the female closure element was made with projections 30, and the male closure element was made with projections 31 as depicted in FIG. 19. Projection 30 on the inside hook had a length of about 7.0 mils, and that on the outside hook had a length of about 7.6 mils. Projection 31 on the inside hook had a length of about 4.0 mils, and that on the outside hook had a length of about 5.3 mils. Further, the inside hook of the male closure element had a length of about 8.6 mils, whereas the outside hook of the male closure element had a length of about 6.6 mils. In addition, the inside hook of the female closure element had a length of about 10.0 mils, whereas the outside hook of the female closure element had a length of about 8.6 mils. Still further, the base and web portions of both the male and female closure elements were larger than those of the closure elements of Example 5.

Figure 20:
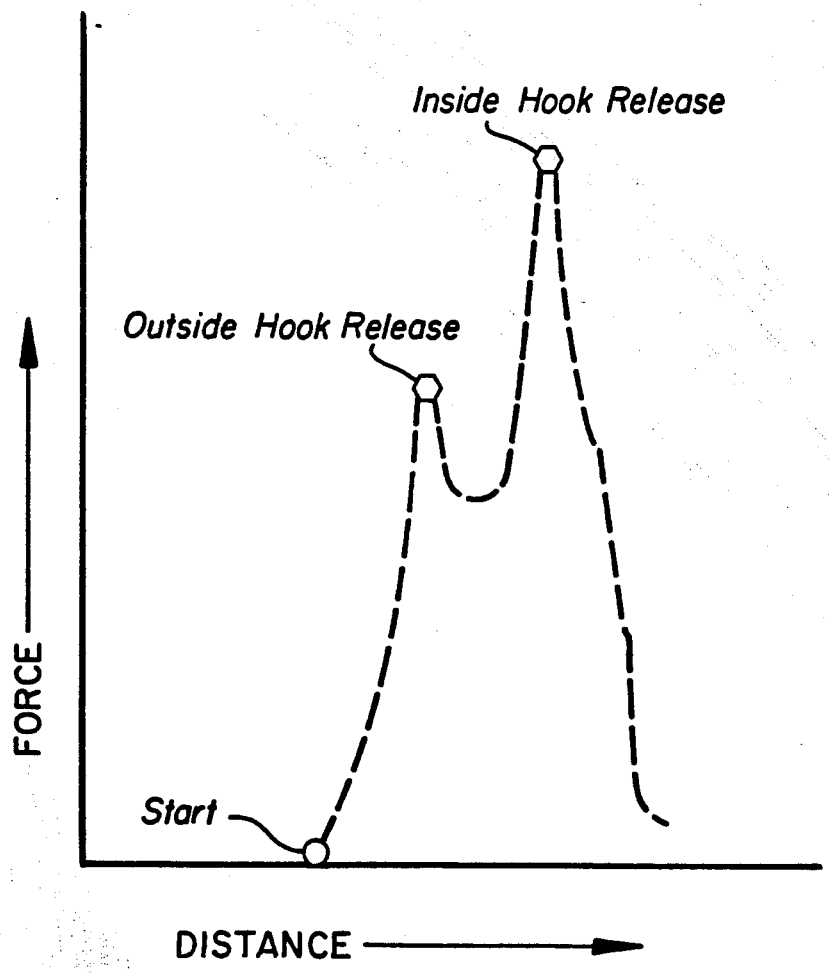
FIG. 20 is a portion of an Instron tensile test curve showing the double peak representing the outside opening forces for the controlled separation closure.

FIG. 20 depicts a typical double peak Instron test curve demonstrating the expected double forces experienced when the closure of FIG. 19 is opened as first the hooks on the right side of the figure release, and then the hooks on the left side of the figure release.

From the above results in Table II, it can be seen that pursuant to this invention the zippering force, which is a measure of the controlled separation characteristics of a partially deoccluded interlocking closure fastening device, may be modified independently from the force required to deocclude the outside hooks of the completely occluded interlocking closure fastening device. Likewise, the zippering force of a partially deoccluded interlocking closure fastening device may be modified without substantially affecting the force required to deocclude the inside hooks of the completely occluded interlocking closure fastening device.

Further, from the results in Table II it may be seen that providing projections 30 on the female closure as in Example 4 has a measurable effect on the zipper strength values obtained when comparing the zipper strength values with those obtained for the structure of the Control. Further, when the female closure element has projections 30 and the male closure element has projections 31 per Example 5, the zipper strength of the interlocking closure fastening device is substantially increased. In addition, when the interlocking closure fastening device having the structure of Example 5 contained 20 weight percent high density polyethylene in the female closure element per Example 6, the zipper strength of the interlocking closure fastening device was further increased over that of the fastening device of Example 5. The higher zipper strength value obtained for the structure of the interlocking closure fastening device of Example 7 demonstrates that the presence of projections 30 on the female closure element of this invention, the presence of projections 31 on the male closure element of copending application Ser. No. 509,388, and enlargement in size of the base and web portions of both closure elements provide significantly improved controlled separation characteristics to an interlocking closure fastening device.

A closure fastening device in accordance with this invention can also be used as a flexible straw because a good seal at the engaged surfaces is possible and a compartment defined by the occluded closure elements provides a passageway which does not collapse when the closure fastening device is bent moderately.

Generally, the closure fastening device of this invention can be manufactured in a variety of forms to suit the intended use. In addition, the male and female closure elements can be positioned on opposite sides of a film. Such an embodiment would be suited for enwrapping an object or a collection of objects such as wires. Generally, the male and female closure elements on a film should be parallel to each other, but this would depend on the intended use.

I wish it to be understood that I do not desire to be limited to the exact details of construction shown and described, for alternative embodiments will occur to a person skilled in the art.

Having thus described the invention, what I claim as new and desire to be secured by Letters Patent is as follows:

1. An interlocking closure fastening device comprising a male closure element and a female closure element formed such that said male closure element and said female closure element engage in interlocking relationship; said male closure element comprising a substantially linear U-shaped channel element including a profile portion comprising a base portion having a pair of spaced-apart, parallelly disposed webs integrally attached to said base portion and extending therefrom, said webs terminating in hooks, said hooks comprising hook portions facing away from each other and hook projections facing toward each other; said female closure element comprising a substantially linear U-shaped channel element including a profile portion comprising a base portion having a pair of spaced-apart, parallelly disposed webs extending from said base portion, said webs terminating in hooks extending nonlinearly from said webs and facing toward each other, said hooks each including a projection extending nonlinearly in a direction outwardly and downwardly with respect to said base portion and facing away from each other; each of said projections being characterized as providing guidance for occlusion of said female closure element with said male closure element; and wherein said female closure element further provides controlled separation characteristics to said interlocking closure fastening device when said interlocking closure fastening device is partially deoccluded.

2. An interlocking closure fastening device in accordance with claim 1 wherein said base portion of said female closure element is resiliently bendable.

3. An interlocking closure fastening device in accordance with claim 1 wherein said base portion of male closure element is resiliently bendable.

4. An interlocking closure fastening device in accordance with claim 1 wherein at least one of said webs of said female closure element is resiliently bendable.

5. An interlocking closure fastening device in accordance with claim 1 wherein at least one of said webs of said male closure element is resiliently bendable.

6. An interlocking closure fastening device in accordance with claim 1 wherein at least one of said hooks of said female closure element is resiliently bendable.

7. An interlocking closure fastening device in accordance with claim 1 wherein at least one of said hooks of said male closure element is resiliently bendable.

8. An interlocking closure fastening device in accordance with claim 1 wherein said base portion of said female closure element includes a flange portion.

9. An interlocking closure fastening device in accordance with claim 1 wherein said base portion of said male closure element includes a flange portion.

10. An interlocking closure fastening device in accordance with claim 1 wherein at least one of said projections of said female closure element is resiliently bendable.

11. An interlocking closure fastening device in accordance with claim 1 wherein at least one of said projections of said male closure element is resiliently bendable.

12. An interlocking closure fastening device having an occluded height of between about 50 mils and about 100 mils, and a corresponding occluded width of between about 60 mils and about 150 mils, said interlocking closure fastening device comprising a male closure element and a female closure element formed such that said male closure element and said female closure element engage in interlocking relationship; said male closure element comprising a substantially linear U-shaped channel element including a profile portion comprising a base portion having a pair of spaced-apart, parallelly disposed webs integrally attached to said base portion and extending therefrom, said webs terminating in hooks, said hooks comprising hook portions facing away from each other and hook projections facing toward each other; said female closure element comprising a substantially linear U-shaped channel element including a profile portion comprising a base portion having a pair of spaced-apart, parallelly disposed webs extending from said base portion, said webs terminating in hooks extending non-linearly from said webs and facing toward each other, said hooks each including a projection extending nonlinearly in a direction outwardly and downwardly with respect to said base portion and facing away from each other; each of said projections being characterized as providing guidance for occlusion of said female closure element with said male closure element; and wherein said female closure element further provides controlled separation characteristics to said interlocking closure fastening device when said interlocking closure fastening device is partially deoccluded.

13. An interlocking closure fastening device in accordance with claim 12 wherein each of said projections extending from said hooks of said female closure element has a length, on a proportionate scale to the occluded height and occluded width of said interlocking closure fastening device, of between about 8 mils and about 18 mils.

14. An interlocking closure fastening device in accordance with claim 12 wherein said hooks on said female closure element have a length, on a proportionate scale to the occluded height and occluded width of said interlocking closure fastening device, of between about 5 mils and about 12 mils.

15. An interlocking closure fastening device in accordance with claim 12 wherein said hook projections on said hooks of said male closure element have lengths, on a proportionate scale to the occluded height and occluded width of said interlocking closure fastening device, of between about 5 mils and about 20 mils.

16. An interlocking closure fastening device in accordance with claim 12 wherein said hook portions of said male closure element have lengths, on a proportionate scale to the occluded height and occluded width of said interlocking closure fastening device, of between about 5 mils and about 12 mils.

17. An interlocking closure fastening device in accordance with claim 12 wherein said base portions of said female closure element is resiliently bendable.

18. An interlocking closure fastening device in accordance with claim 12 wherein said base portion of said male closure element is resiliently bendable.

19. An interlocking closure fastening device in accordance with claim 12 wherein at least one of said webs of said female closure element is resiliently bendable.

20. An interlocking closure fastening device in accordance with claim 12 wherein at least one of said webs of said male closure element is resiliently bendable.

21. An interlocking closure fastening device in accordance with claim 12 wherein at least one of said hooks of said female closure element is resiliently bendable.

22. An interlocking closure fastening device in accordance with claim 12 wherein at least one of said hooks of said male closure element is resiliently bendable.

23. An interlocking closure fastening device in accordance with claim 12 wherein said base portion of said female closure element includes a flange portion.

24. An interlocking closure fastening device in accordance with claim 12 wherein said base portion of said male closure element includes a flange portion.

25. An interlocking closure fastening device in accordance with claim 12 wherein at least one of said projections of said female closure element is resiliently bendable.

26. An interlocking closure fastening device in accordance with claim 12 wherein at least one of said projections of said male closure element is resiliently bendable.

27. A container including two sidewalls and an interlocking closure fastening device comprising a male closure element and a female closure element formed such that said male closure element and said female closure element engage in interlocking relationship; said male closure element comprising a substantially linear U-shaped channel element including a profile portion comprising a base portion having a pair of spaced-apart, parallelly disposed webs integrally attached to said base portion and extending therefrom, said webs terminating in hooks, said hooks comprising hook portions facing away from each other and hook projections facing toward each other; said female closure element comprising a substantially linear U-shaped channel element including a profile portion comprising a base portion having a pair of spaced-apart, parallelly disposed webs extending from said base portion, said webs terminating in hooks extending nonlinearly from said webs and facing toward each other, said hooks each including projection extending nonlinearly in a direction outwardly and downwardly with respect to said base portion and facing away from each other; each of said projections being characterized as providing guidance for occlusion of said female closure element with said male closure element; and wherein said female closure element further provides controlled separation characteristics to said interlocking closure fastening device when said interlocking closure fastening device is partially deoccluded.

28. A container in accordance with claim 27 wherein said base portion of said female closure element is resiliently bendable.

29. A container in accordance with claim 27 wherein said base portion of said male closure element is resiliently bendable.

30. A container in accordance with claim 27 wherein at least one of said webs of said female closure element is resiliently bendable.

31. A container in accordance with claim 27 wherein at least one of said webs of said male closure element is resiliently bendable.

32. A container in accordance with claim 27 wherein at least one of said hooks of said female closure element is resiliently bendable.

33. A container in accordance with claim 27 wherein at least one of said hooks of said male closure element is resiliently bendable.

34. A container in accordance with claim 27 wherein said base portion of said female closure element includes a flange portion.

35. A container in accordance with claim 27 wherein said base portion of said male closure element includes a flange portion.

36. A container in accordance with claim 27 wherein at least one of said projections of said female closure element is resiliently bendable.

37. A container in accordance with claim 27 wherein at least one of said projections of said male closure element is resiliently bendable.

38. A container including two sidewalls and an interlocking closure fastening device having an occluded height of between about 50 mils and about 100 mils, and a corresponding occluded width of between about 60 mils and about 150 mils, said interlocking closure fastening device comprising a male closure element and a female closure element formed such that said male closure element and said female closure element engage in interlocking relationship; said male closure element comprising a substantially linear U-shaped channel element including a profile portion comprising a base portion having a pair of spaced-apart, parallelly disposed webs integrally attached to said base portion and extending therefrom, said webs terminating in hooks, said hooks comprising hook portions facing away form each other and hook projections facing toward each other; said female closure element comprising a substantially linear U-shaped channel element including a profile portion comprising a base portion having a pair of spaced-apart parallelly disposed webs extending from said base portion, said webs terminating in hooks extending nonlinearly from said webs and facing toward each other, said hooks each including a projection extending nonlinearly in a direction facing away from each other; each of said projections being characterized as providing guidance for occlusion of said female closure element with said male closure element; and wherein said female closure element further provides controlled separation characteristics to said interlocking closure fastening device when said interlocking closure fastening device is partially deoccluded.

39. A container in accordance with claim 38 wherein each of said projections extending from said hooks of said female closure element has a length, on a proportionate scale to the occluded height and occluded width of said interlocking closure fastening device, of between about 8 mils and about 18 mils.

40. A container in accordance with claim 38 wherein said hooks on said female closure element have a length, on a proportionate scale to the occluded height and occluded width of said interlocking closure fastening device, of between about 5 mils and 12 mils.

41. A container in accordance with claim 38 wherein said hook projections on said hooks of said male closure element have lengths, on a proportionate scale to the occluded height and occluded width of said interlocking closure fastening device, of between about 5 mils and about 20 mils.

42. A container in accordance with claim 38 wherein said hook portions of said male closure element have lengths, on a proportionate scale to the occluded height and occluded width of said interlocking closure fastening device, of between about 5 mils and about 12 mils.

43. A container in accordance with claim 38 wherein said base portion of said female closure element is resiliently bendable.

44. A container in accordance with claim 38 wherein said base portion of said male closure element is resiliently bendable.

45. A container in accordance with claim 38 wherein at least one of said webs of said female closure element is resiliently bendable.

46. A container in accordance with claim 38 wherein at least one of said webs of male closure element is resiliently bendable.

47. A container in accordance with claim 38 wherein at least one of said hooks of said female closure element is resiliently bendable.

48. A container in accordance with claim 38 wherein at least one of said hooks of said male closure element is resiliently bendable.

49. A container in accordance with claim 38 wherein said base portion of said female closure element includes a flange portion.

50. A container in accordance with claim 38 wherein said base portion of said male closure element includes a flange portion.

51. A container in accordance with claim 38 wherein at least one of said projections of said female closure element is resiliently bendable.

52. A container in accordance with claim 38 wherein at lest one of said projections of said male closure element is resiliently bendable.

* * * * *